US005294938A

United States Patent [19]

Matsuo et al.

[11] Patent Number: 5,294,938

[45] Date of Patent: Mar. 15, 1994

[54] CONCEALEDLY MOUNTED TOP LOADED VEHICULAR ANTENNA UNIT

[75] Inventors: Masayuki Matsuo, Neyagawa; Kazuhiro Matsumoto, Hirakata; Kazunori Matsumoto, Shijonawate, all of Japan

[73] Assignee: Matsushita Electric Works, Ltd., Osaka, Japan

[21] Appl. No.: 851,508

[22] Filed: Mar. 16, 1992

[30] Foreign Application Priority Data

| | | | |
|---|---|---|---|
| Mar. 15, 1991 | [JP] | Japan | 3-014967 |
| Mar. 15, 1991 | [JP] | Japan | 3-050032 |
| Jun. 25, 1991 | [JP] | Japan | 3-15279 |

[51] Int. Cl.[5] ..... H01Q 9/40

[52] U.S. Cl. ..... 343/829; 343/872

[58] Field of Search ..... 343/700 MS, 713, 830, 343/846, 750, 752, 872, 829, 878; H01Q 1/32, 9/40, 1/42

[56] References Cited

U.S. PATENT DOCUMENTS

| | | | |
|---|---|---|---|
| 3,852,760 | 12/1974 | Reggia | 343/830 |
| 4,821,040 | 4/1989 | Johnson et al. | 343/700 MS |
| 4,903,033 | 2/1990 | Tsao et al. | 343/700 MS |
| 4,994,820 | 2/1991 | Suzuki et al. | 343/700 MS |
| 5,146,232 | 9/1992 | Nishikawa et al. | 343/713 |

FOREIGN PATENT DOCUMENTS 0376643 7/1990 European Pat. Off. .

*Primary Examiner*—Michael C. Wimer

*Attorney, Agent, or Firm*—Stevens, Davis, Miller & Mosher

[57] ABSTRACT

A top loaded antenna unit is provided for concealed mounting within a vehicle below a covering or panel of dielectric material. The antenna unit includes a top load plate, a ground plate disposed in a spaced relation to the top load plate and electromagnetically coupled thereto through a matching element. The antenna unit additionally includes a dielectric member which is disposed in proximity to the top load plate for shifting resonance frequency of the antenna to a predetermined extent. The top load plate and the ground plate are assembled together with the dielectric member into a unitary structure for mounting within the vehicle below the covering or panel of dielectric material, at which condition resonance frequency of the antenna can be free from being affected from the covering or panel of the vehicle but affected solely from the dielectric member of which effect on the frequency shifting is known. Whereby, the antenna can give stable resonance frequency as intended only in consideration of the dielectric member and without being substantially influenced by other outside environments.

2 Claims, 6 Drawing Sheets 50
51
10
11
51
51
12
20
13
51
30

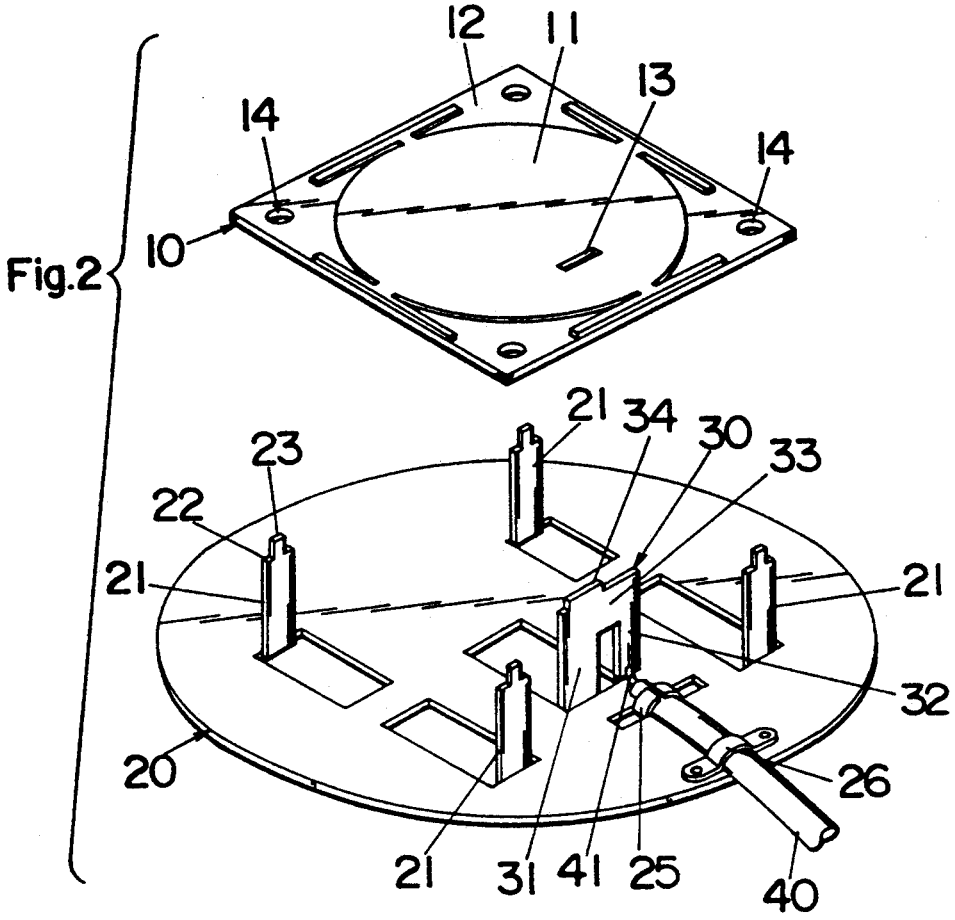
Fig.3
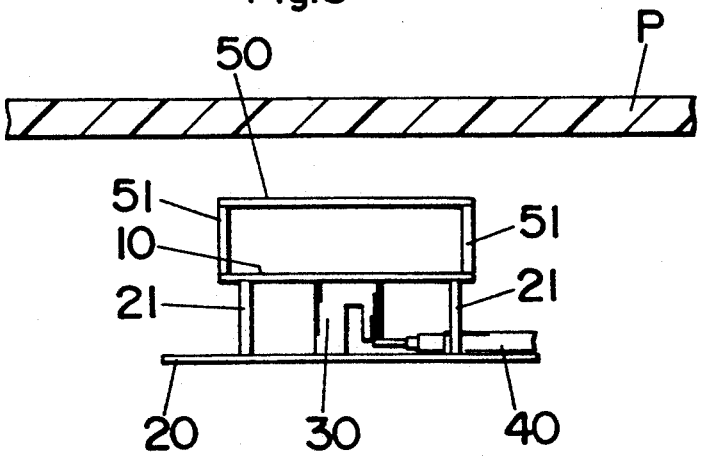

Fig.4
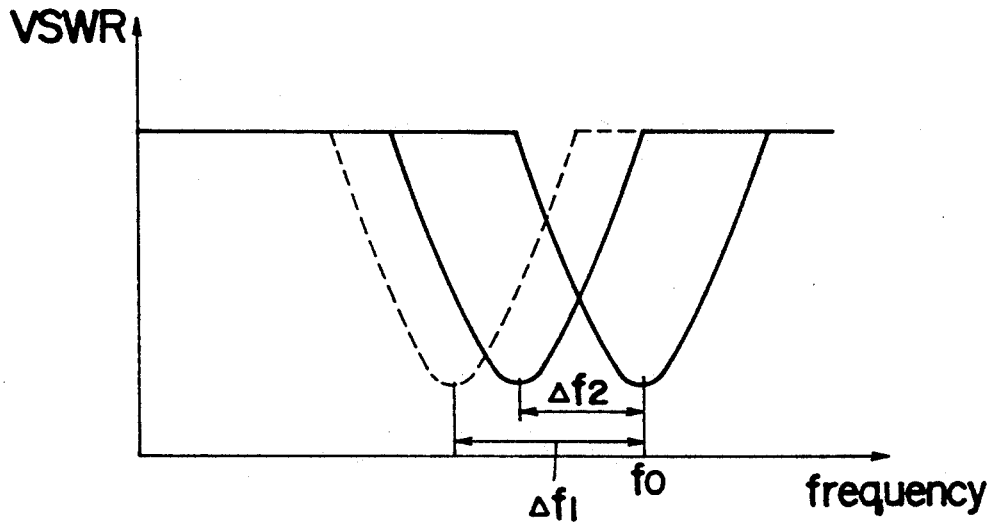
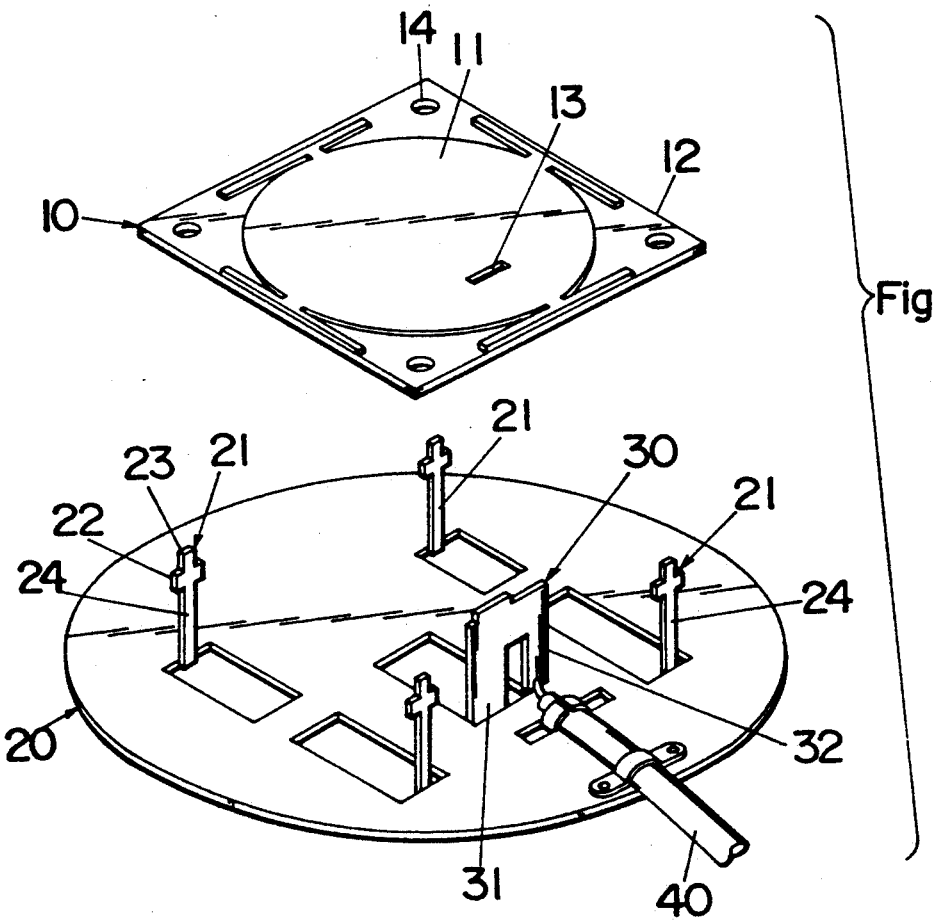
Fig.5

CONCEALEDLY MOUNTED TOP LOADED VEHICULAR ANTENNA UNIT

BACKGROUND OF THE INVENTION

1. Field of the Invention

The present invention is directed to a top loaded antenna unit, and more particularly to a top loaded antenna unit which is mounted in a concealed manner within a vehicle for mobile transmission.

2. Description of the Prior Art

In recent years, top loaded antennas have become of interest for use in mobile transmissions due to their superior nondirectional characteristic and low profile structure. The top loaded antenna is mostly required to be not visible, when mounted in a vehicle, so as not to mar the appearance and not to be noticed or fooled by a burglar. For this purpose, it is a general practice to mount the antenna within a portion of the vehicle adjacent a front or rear windshield below a dashboard or the like covering made of dielectric material. When so mounted, there arises a problem that resonance frequency of the antenna will shift by $\Delta f_1$ to a lower side from an intended frequency $f_0$ due to the influence of the adjacent dielectric material, as shown in FIG. 4, and the shifting amount will be greater as the antenna is closer to the covering of the dielectric material. In order to compensate for the low-going shifting of resonance frequency, it is required to set a resonance frequency at a level greater than an intended frequency at the time of shipping the antenna. However, this scheme is not satisfactory and fails to achieve precise compensation or adjustment of resonance frequency to an intended frequency since the shifting amount will vary indefinitely. This is because the dielectric material used will differ from different vehicles and also because the antenna will be spaced at varying distances from the covering due to different structural limitations in different types or models of the vehicles.

SUMMARY OF THE INVENTION

The above problem has been successfully eliminated in the present invention which provides an improved top loaded vehicular antenna unit. The antenna unit in accordance with the present invention comprises a top load plate, a ground plate disposed in a spaced relation to the top load plate and electromagnetically coupled thereto through a matching element. The antenna unit additionally includes a dielectric member which is disposed in a closely adjacent relation to the top load plate for shifting resonance frequency of the antenna by a predetermined extent. The top load plate and the ground plate are assembled together with the dielectric member into a unitary structure which is to be mounted within a vehicle below a covering or panel of dielectric material at a portion, for example, adjacent the front or rear windshield. The antenna unit of the present invention is designed based upon the fact that resonance frequency is affected or lowered substantially only from the most adjacent dielectric member and not from other dielectric members located far away therefrom. That is, when mounted within the vehicle below the covering or panel of dielectric material, the antenna characteristic can be only affected substantially from the adjacently disposed dielectric member having a known effect on the shifting of resonance frequency and not from the covering or the panel which may be spaced at varying distances from the top load plate for different models or types of the vehicle and which may be of different materials from different models or types of the vehicle. Consequently, it is readily possible to obtain a desired resonance frequency in consideration of only the dielectric member incorporated within the antenna unit.

Accordingly, it is a primary object of the present invention to provide an improved top loaded antenna unit which is capable of keeping an intended resonance frequency free from being affected by outside environments or mounting sites within the vehicle.

The dielectric member may be located above or below the top load plate as required. Locating the dielectric member below the top load plate is particularly advantageous for assembling the unit in a low-profile configuration so that it is readily mounted within a limited space below the covering or panel the vehicle, which is therefore another object of the present invention.

Preferably, the top load plate comprises a substrate of dielectric material formed thereon with a conductor pattern. The substrate is secured on the ground plate by means of spacers of dielectric material interposed therebetween. With the use of the dielectric spacers, the antenna unit can be physically consolidated so as to be strong against external shocks, thereby assuring stable antenna characteristics over an extended period of use.

It is therefore a further object of the present invention to provide an improved top loaded antenna unit which is capable of being assembled into a consolidated structure sufficiently strong against shocks.

Alternately, the substrate may be secured on the ground plate by means of metal spacers disposed therebetween. Due to relatively low thermal deformation that the metal exhibits, the metal spacers act to maintain the set distance between the top load plate and the ground plate substantially free from variations in ambient temperatures, thereby assuring stable antenna characteristics irrespective of the variations in the ambient temperature.

It is therefore a still further object of the present invention to provide an improved top loaded antenna unit which is stable against variations in the ambient temperature for assuring constant antenna characteristics.

The metal spacers may be formed commonly from the ground plate and struck therefrom to integrally extend toward the top load plate for supporting the top load plate at their ends. This is advantageous for reducing the number of components and therefore for facilitating the assembly of the antenna unit, which is therefore a still further object of the present invention.

The metal spacers are preferred to have narrowed sections at portions not in supporting relation to the top load plate in order to minimize undesired effects on the antenna characteristics by the presence of the metal spacers.

Moreover, the antenna may include an adjustor mechanism for varying a distance between the top load plate and the dielectric member. This is particularly advantageous in that the resonance frequency of the antenna can be precisely adjusted at an installation site.

It is therefore a further object of the present invention to provide an improved top loaded antenna unit which is capable of precisely adjusting the resonance frequency for optimum efficiency.

These and still other objects and advantageous features of the present invention will become more apparent from the following description of the embodiments when taken in conjunction with the attached drawings.

BRIEF DESCRIPTION OF THE DRAWINGS

FIG. 2 is an exploded perspective view of the antenna with a dielectric member removed therefrom;

FIG. 3 is a schematic view of the antenna unit when mounted below a panel of dielectric material within a vehicle;

FIG. 4 is a graph explaining a low-going shift of resonance frequency of the antenna in comparison with that expected in the prior art antenna;

FIG. 5 is an exploded perspective view, similar to FIG. 2, but illustrating a modified structure of metal spacers for supporting a top load plate;

DETAILED DESCRIPTION OF THE EMBODIMENTS

Figure 1:
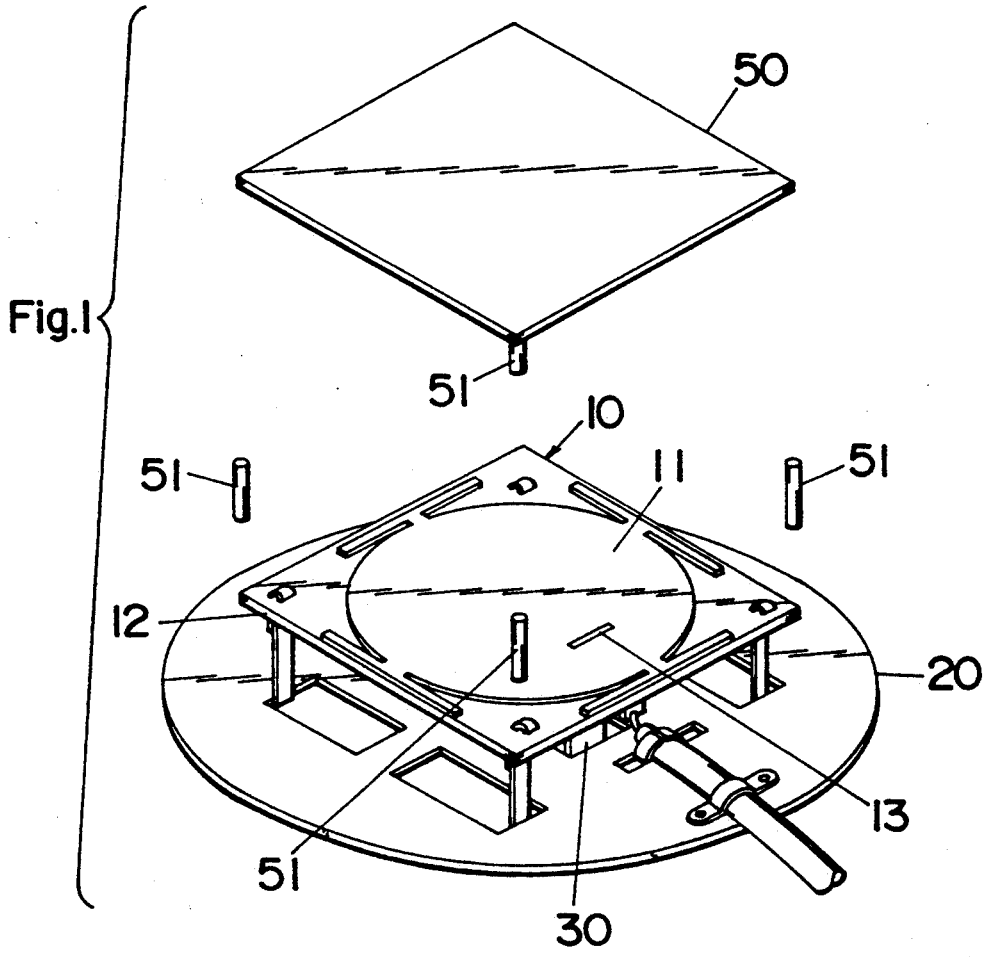
FIG. 1 is an exploded perspective view of a top loaded antenna unit in accordance with a first embodiment of the present invention.

Referring now to FIGS. 1 to 3, there is shown a top loaded antenna unit in accordance with a first embodiment of the present invention. The antenna unit shown in the figure is configured to cover a UHF frequency of 900 MHz band, and comprises a top load plate 10 with a conductor pattern 11 of 30 mm radius, a ground plate 20 of 50 mm radius, and a matching element 30. The top load plate 10 is fabricated in the form of a printed board having a generally disc-shaped top load conductor pattern 11 on a square dielectric substrate 12. The ground plate 20 is made from a conductive metal such as a steel or the like. The matching element 30, which is formed commonly from the ground plate 20 and is struck therefrom to remain integral therewith, comprises a 15 mm long shortline 31 and a 10 mm long feedline 32 which extend in parallel relation to one another and are joined at the upper ends by an integral bridge segment 33 with an upwardly projecting stud 34. The stud 34 engages into a corresponding slot 13 in the top load plate 10 for establishing an electrical connection between the ground plate 20 and the conductor pattern 11 through the shortline 31 as well as a physical connection between the ground plate 20 and the top load plate 10. The ground plate 20 is additionally formed with a set of circumferentially arranged spacer legs 21 which are also struck from the ground plate 20 to remain integral therewith and bent towards the top load plate 10. Each of the spacer legs 21 defines at its upper end a shoulder 22 with an upwardly extending tongue 23, which extends into corresponding one of holes 14 formed in the four corners of the top load plate 10 and is bent on the periphery of the hole 14 for securing the top load plate 10 to the upper end of the spacer leg 21 while supporting the top load plate 10 on the shoulder 22 of the spacer leg 21. Thus, the top load plate 10 is physically coupled to the ground plate 20 by means of the spacer legs 21 and also the matching element 30 to keep the top load plate 10 at a fixed distance from the ground plate 20.

An antenna cable 40, which is a coaxial cable, is coupled at its center conductor 41 to the lower end of the feedline 32 and at its outer conductor to the ground plate 20 by lanced fingers 25 which are struck from the ground plate 20 and bent over the outer conductor. The cable 40 is physically secured to the ground plate 20 by means of the fingers 25 and a retainer 26.

Also included in the antenna unit is a dielectric plate 50 which is made of a suitable plastic such as an acrylic resin into the same planar dimension as the top load plate 10. The dielectric plate 50 is placed closely on the top load plate 10 by means of posts 51 to be held at a fixed distance from the top load plate 10 in order that resonance frequency of the antenna is affected only by thus incorporated dielectric plate 50 and can be kept intact from other dielectric materials present in a mounting site. That is, when the antenna unit is mounted within a vehicle in a concealed manner, the antenna unit should be located below a covering or panel P of dielectric material, as shown in FIG. 3, at a portion, for example, adjacent the front or rear windshield or the like portion exposed to the outside directly or through non-metallic member capable of passing radio waves. Therefore, some dielectric material such as the panel P is always present in the vicinity of the antenna unit concealedly mounted within the vehicle and acts to shift the resonance frequency to a lower side by an uncertain amount in the absence of the incorporated dielectric member. With the incorporation of the dielectric member 50, however, the antenna characteristic is affected substantially solely from the dielectric member 50 which is most adjacent to the top load plate 10 and not from the other possible dielectric materials, such as the panel P in FIG. 3. This means that the shifting amount of the resonance frequency can be known and kept at a fixed value and therefore can be correctly compensated for assuring stable antenna characteristic free from being affected by the other dielectric materials present in the mounting site. Further, since the dielectric member 50 of limited size is incorporated within the antenna unit adjacent the top load plate 10, the resonance frequency f0 can be lowered only by a limited amount $\Delta f_2$ less than that $\Delta f_1$ normally expected when a like antenna unit without the dielectric plate is mounted below the vehicle's covering or panel of relatively great size, as shown in FIG. 4. This demonstrates that the antenna unit of the present invention can minimize the shifting of the resonance frequency for easy and correct frequency compensation.

It is noted here that the spacer legs 21 commonly formed from the ground plate 20 are of inherently less thermal expansion due to the metallic nature and therefore serve to keep the top load plate 10 at substantially a fixed distance from the ground plate 20 even exposed to a considerable temperature change, thereby assuring a stable antenna characteristic against the temperature change which is very likely to occur for use in the vehicle. In order to nevertheless reduce the effect of the metallic spacer leg upon the antenna characteristics, it is preferred that, as shown in FIG. 5, each of the spacer legs 21 is configured to have a narrowed section 24 along its length except for the shoulder 22. The other structures are identical to the first embodiment and therefore no further explanation is deemed unnecessary to the antenna unit of FIG. 5.

Figure 6:
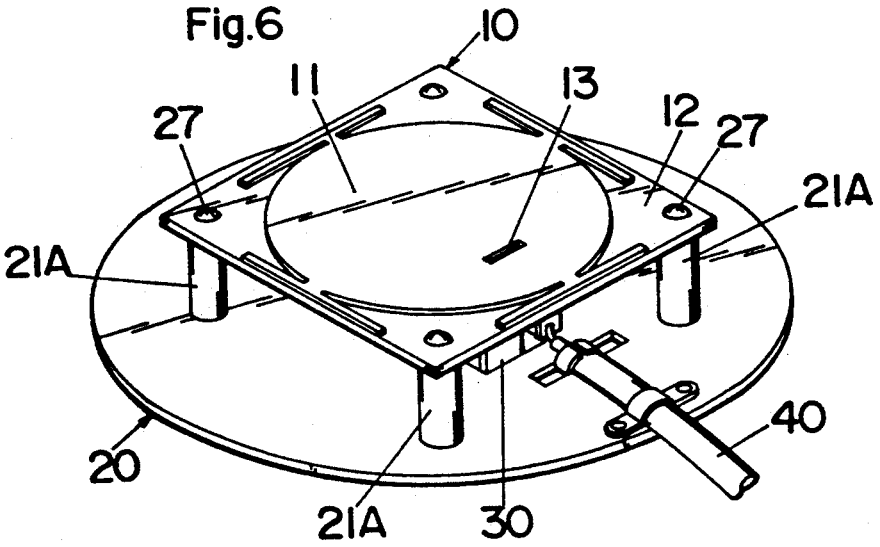
FIG. 6 is a perspective view illustrating a top loaded antenna unit with a dielectric member removed in accordance with another modification of the above embodiment.

FIG. 6 illustrates another modification of the above antenna unit which is identical in structure and operation to the first embodiment except that spacers 21A of dielectric material are utilized instead of the spacer legs 21 to support the top load plate 10A at a fixed distance from the ground plate 20A. The spacers 21A are each in the form of cylindrical barrel through which a screw 27 extends from the top load plate 10A for securing the top load plate 10A to the ground plate 20A. Like parts are designated by like numerals with a suffix letter of "A". Although not seen in FIG. 6, a like dielectric plate is supported on the top load plate 10A in a closely spaced relation thereto for the same reason as discussed in the above.

Figure 7:
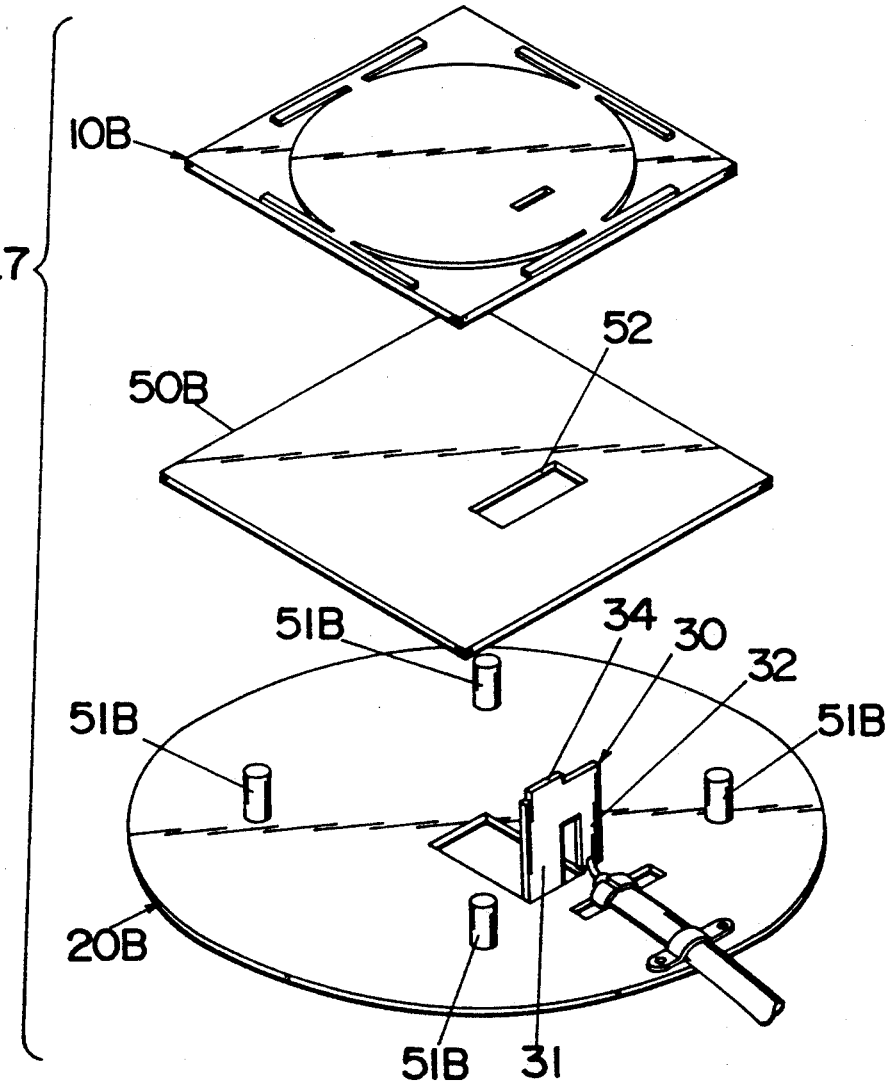
FIG. 7 is an exploded perspective view of a top loaded antenna unit in accordance with a second embodiment of the present invention.
Figure 8:
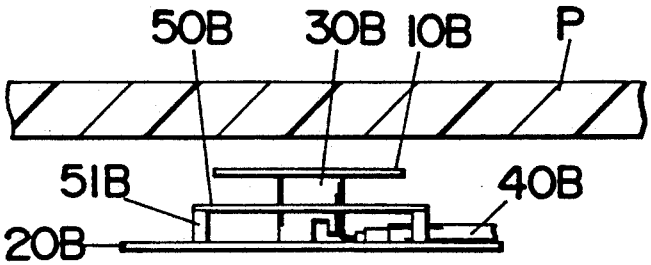
FIG. 8 is a schematic view of the antenna unit of FIG. 7 when mounted below a covering or panel of dielectric material within the vehicle.

FIGS. 7 and 8 illustrates an antenna unit in accordance with a second embodiment of the present invention which includes a top load plate 10B and a ground plate 20B both of which are similar to those of the first embodiment. The ground plate 20B is formed integral with a like matching element 30B by which the top load plate 10B is supported at a fixed distance above the ground plate 20B. A like dielectric plate 50B is supported on the ground plate 20B by means of a set of posts 51B in such a manner as to be disposed below the top load plate 10B at a fixed distance therefrom. The dielectric plate 50B has a window 52 through which the matching element 30B extends for coupling to the top load plate 10B. The other structures are identical to those of the first embodiment and are deemed unnecessary to repeat here. Thus formed antenna unit is of a low-profile structure and therefore can be mounted within a limited space within the vehicle below a covering or panel P of dielectric material, as shown in FIG. 8, in which case the incorporated dielectric member 50B acts to keep the resonance frequency free from being affected by the other dielectric material for the same purpose as discussed with reference to the first embodiment.

Figure 9:
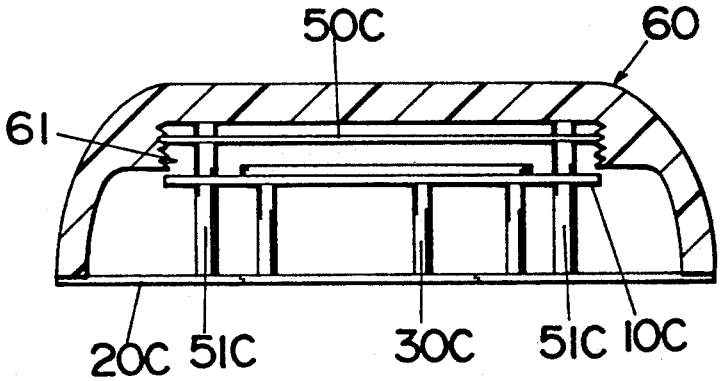
FIG. 9 is a vertical section of a top loaded antenna unit in accordance with a third embodiment of the present invention.
Figure 10:
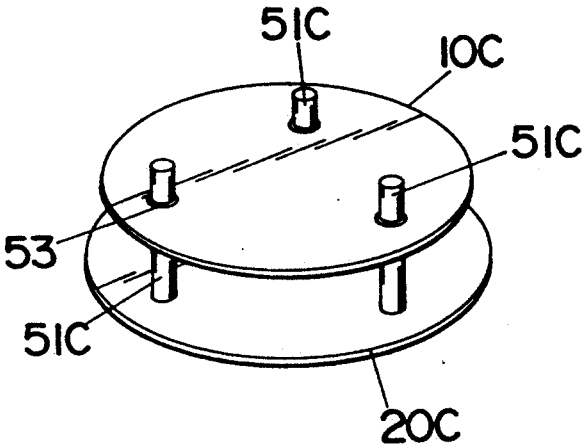
FIG. 10 is a perspective view of a portion of the antenna unit of FIG. 9.

FIGS. 9 and 10 illustrate a third embodiment of the present invention which includes a cap 60, in addition to a top load plate 10C, ground plate 20C, and dielectric plate 50C which are similar to those of the first embodiment. The dielectric plate 50C is supported by means of posts 51C extending from the ground plate 20C upwardly through the top load plate 10C and through circumferentially spaced holes 53 in the periphery of the dielectric plate 50C, as shown in FIG. 10, such that the dielectric plate 50C is vertically movable relative to the top load plate 10C. The cap 60, which is made of dielectric plastic material to have a circular section, is fitted over the dielectric plate 50C with its lower circumferential end rested on the periphery of the ground plate 20C, as shown in FIG. 9, and is allowed to rotate about a vertical center axis. The cap 60 is formed in its interior side wall with a thread 61 which engages the periphery of the dielectric plate 50C such that the dielectric plate 50C is lowered and raised upon rotating the cap 60. Thus, the distance between the dielectric plate 50C and the top load plate 10C can be varied by rotating the cap 60, which enables to precisely adjust the shifting amount of the resonance frequency and therefore facilitates the compensation for the low-going shifting of the resonance frequency. It is noted here that the top load plate 10C is kept at a fixed distance from the ground plate 20C by the matching element 30C and also by the posts 51C.

Figure 11:
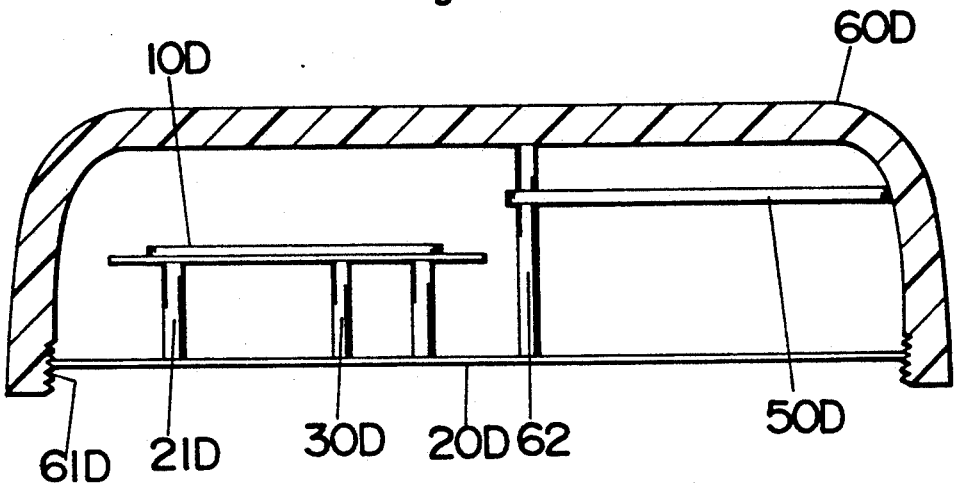
FIG. 11 is a vertical section of a top loaded antenna unit in accordance with a fourth embodiment of the present invention.

FIG. 11 illustrate a fourth embodiment of the present invention which also includes a cap 60D of dielectric material fitted over a like dielectric plate 50D and top load plate 10D. The cap 60D has a circular horizontal section and is formed at its inner lower end with a thread 61D which engages with the periphery of a like ground plate 20D so as to be rotatable relative thereto about a vertical center axis. The dielectric plate 50D is a semi-circular plate held in parallel with the top load plate 10D within the cap 60D between the inner wall thereof and a center rod 62 defining the vertical center axis. Upon rotation of the cap 60D, therefore, the dielectric plate 50D moves over and away from the top load plate 10D so as to vary an overlapping amount relative to the top load plate 10D, thereby enabling to precisely adjust the shifting amount of the resonance frequency. The top load plate 10D is kept at a fixed distance from the ground plate 20d by the matching element 30D and also by like spacer legs 21D.

Figure 12:
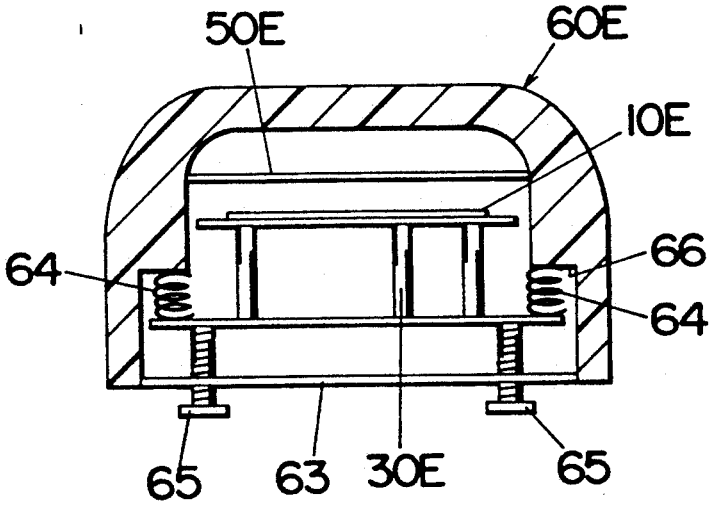
FIG. 12 is a vertical section of a top loaded antenna unit in accordance with a fifth embodiment of the present invention.

FIG. 12 illustrates an antenna unit in accordance with a fifth embodiment of the present invention which includes a like cap 60E and a base plate 63 closing a bottom opening of the cap 60E. A like top load plate 10E and a like ground plate 20E coupled together by means of a like matching element 30E are accommodated within the cap 60E and are movably supported therein by means of coil springs 64 and adjustor screws 65 with the top load plate 10E opposed to a like dielectric plate 50E held stationary within the upper end portion of the cap 60E. The adjustor screws 65 extend through the base plate 63 into abutment with the ground plate 20E so as to raise or lower the ground plate 20E in cooperation with the coil springs 64 interposed between the ground plate 20E and a stepped shoulder 66 on the interior wall of the cap 60E, thereby varying a distance between the top load plate 10E and the dielectric plate 50E and therefore enabling a precise adjustment of the shifting amount of the resonance frequency.

What is claimed is:

1. A top loaded antenna apparatus adapted to be mounted within a vehicle in a concealed manner, said antenna apparatus comprising:

a top load plate;

a ground plate disposed in a spaced relation to said top load plate and electrically coupled thereto through a matching element;

a dielectric member disposed in an adjacent relation to said top load plate for shifting a resonance frequency of said antenna by a predetermined extent, said top load plate, said ground plate, and said dielectric member being assembled into a unitary structure; and adjustor means, operatively associated with said dielectric member, for varying a distance between said top load plate and said dielectric member.

2. A top loaded antenna apparatus adapted to be mounted within a vehicle in a concealed manner, said antenna apparatus comprising:

a top load plate;

a ground plate disposed in a spaced relation to said top load plate and electrically coupled thereto through a matching element;

a dielectric member disposed in an adjacent relation to said top load plate for shifting a resonance frequency of said antenna by a predetermined extent, said top load plate, said ground plate, and said dielectric member being assembled into a unitary structure; and adjustor means, operatively associated with said dielectric member, for varying an overlapping amount between said top load plate and said dielectric member.

* * * * *